United States Patent [19]

Mazzagatti

[11] Patent Number: 4,514,154

[45] Date of Patent: Apr. 30, 1985

[54] SELF-SEALING ABUTMENT

[76] Inventor: Concezio Mazzagatti, Sante Fe 3786, 4° A, Buenos Aires, Argentina

[21] Appl. No.: 601,749

[22] Filed: Apr. 20, 1984

Related U.S. Application Data

[63] Continuation of Ser. No. 341,126, Jan. 20, 1982, abandoned.

[30] Foreign Application Priority Data

Jul. 16, 1981 [AR] Argentina ..... 286122

[51] Int. Cl.[3] ..... F01C 19/02; F04C 27/00

[52] U.S. Cl. ..... 418/129; 418/248

[58] Field of Search ..... 418/120, 125, 129, 152, 418/235, 243–249

[56] References Cited

U.S. PATENT DOCUMENTS

| | | | |
|---|---|---|---|
| 1,796,535 | 3/1931 | Rolaff | 418/248 |
| 2,155,775 | 4/1939 | Sapp | 418/248 |
| 2,366,213 | 1/1945 | Pover | 418/245 |
| 2,409,141 | 10/1946 | Margolis | 418/248 |
| 3,245,387 | 4/1966 | Froede | 418/123 |
| 3,439,582 | 4/1969 | Smith | 418/245 |
| 3,464,362 | 9/1969 | Ross | 418/219 |
| 3,672,798 | 6/1972 | Scherenberg | 418/113 |
| 3,685,922 | 8/1972 | Lamm | 418/113 |
| 3,942,484 | 3/1976 | Pile | 418/219 |

FOREIGN PATENT DOCUMENTS

| | | | |
|---|---|---|---|
| 1078705 | 8/1967 | United Kingdom | 418/113 |

*Primary Examiner*—Leonard E. Smith
*Assistant Examiner*—Jane E. Obee
*Attorney, Agent, or Firm*—Watson, Cole, Grindle & Watson

[57] ABSTRACT

A self-sealing abutment comprising at least one assembly consisting of two interconnected plate members which are slidable with respect to one another along a sloped plane which extends to the lower base portion of the abutment and divides it into two portions of unequal length, and resilient elements urging the abutment in the direction of its lower base portion, whereby wear thereon can be compensated for.

14 Claims, 12 Drawing Figures

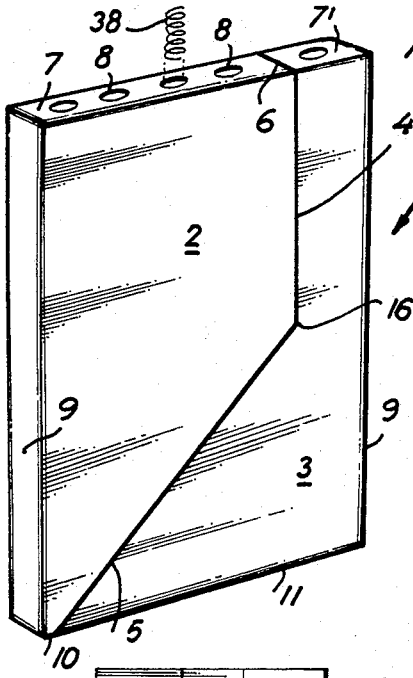
FIG. 1
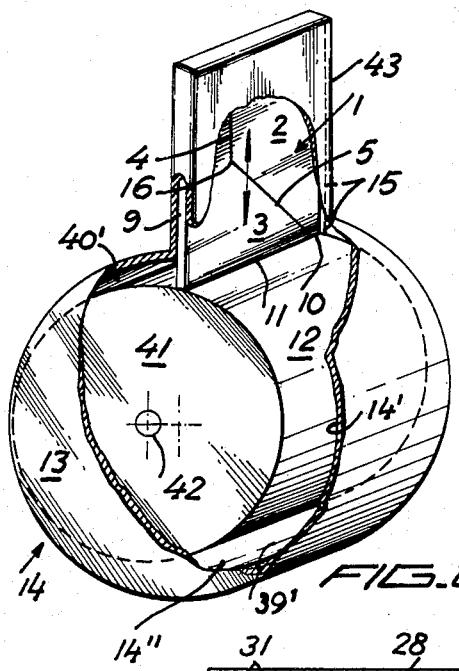
FIG. 2
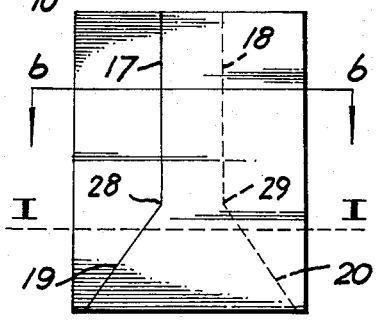
FIG. 3a
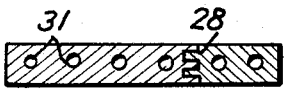
FIG. 4a
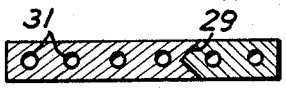
FIG. 4b
FIG. 4c
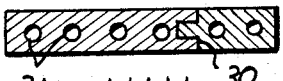
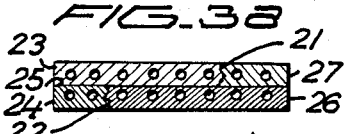
FIG. 3b
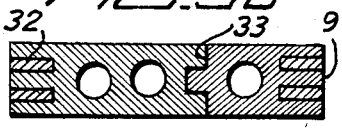
FIG. 5a
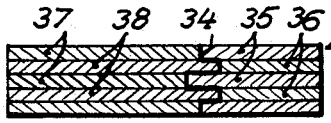
FIG. 5b
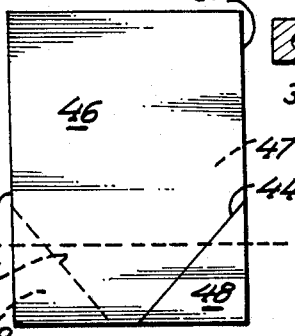
FIG. 7
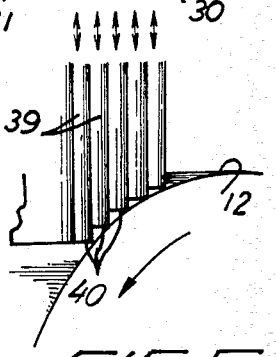
FIG. 6

SELF-SEALING ABUTMENT

This application is a continuation of application Ser. No. 341,126, filed Jan. 20, 1982, now abandoned.

BACKGROUND OF THE INVENTION

1. Field of the Invention

The present invention relates to a self-sealing abutment which divides the variable volume chambers used in fluid operated machines and engines, such as rotary motors, compressors, vacuum pumps, brake systems, mechanical energy accumulator systems and the like, and more particularly the present invention is concerned with a self-sealing abutment which compensates for the wear and tear which take place as a consequence of the frictional engagement between the abutment and the movable members, as well as stationary portions, of such machines, without it being necessary to provide any complementary sealing members to properly seal apart the variable volume chambers which are divided by the abutment.

2. Description of the Prior Art

Fluid operated machines of the type hereinabove cited are known and consist basically of a stator casing defining a substantially cylindrical inner face circumscribing a cylindrical space and within which a rotary, eccentrically mounted piston rotor is rollably located, which upon rolling along the inner face of the stator defines, together with an abutment of the type of the present invention, two variable volume chambers, which, in case for instance of a rotary motor or engine, will respectively become the expansion and compression chambers.

Abutments of this type are plate members and have an upper base portion and lower base portion. A housing projecting out of the stator houses the upper portion including the upper base portion of the diaphragm, the lower base portion of which abuts on the rotary piston in order to maintain a constant contact with the rotary piston. The abutment in combination with the piston rotor, thereby divides the cylindrical space into two variable volume chambers.

It is evident to those skilled in the art that a perfect sealing contact between the abutment and the piston rotor, as well as between the edges of the abutment which are in contact with the housing and the stator casing, should provide a suitably sealed assembly since the variable volume chambers should be perfectly sealed from each other to avoid leakage from one to the other chamber which, if it takes place, reduces considerably the output of the machine.

Within the majority of known fluid operated machines, many suggestions have been made in order to achieve the desired sealing in the most perfect way possible; for instance by providing additional sealing means in conjunction with the edge portions and the lower base portion of the abutment which enter in contact with the stationary housing, the lids of the stator casing and the movable piston rotor. These additional sealing means face the walls of the housing, the stator casing and the piston rotor, and they are usually of very complicated structure. Many sealing members are required since they have to seal several edges, and because they wear quite quickly, they are constantly being improved. The abutment is generally of a poligonal shape, such as rectangular plate.

The maintenance of these sealing members requires a periodical interruption of the operation of the machine for their replacement or at least to check to determine whether their replacement is necessary.

Although these sealing members are being constantly improved, nevertheless such sealing members are required to provide a satisfactory sealing between both variable volume chambers. Although these sealing members are reasonably satisfactory, nevertheless it has to be admitted that these sealing members have a number of drawbacks, bearing in mind that the sealing members must always have a certain resiliency in order to provide a suitable sealing contact, and in addition it is not permitted that there is any play between the sealing members and the walls since such play will immediately produce the undesirable leakage.

In order to achieve a suitable resiliency, it is necessary to apply a constant pressure on the seals against each wall to be sealed. These means usually consist of helicoidal or leaf springs and they must be suitably housed within pertinent recesses to be specially designed therefor. These resilient means are subject to fatigue and to wear, so that their resiliency diminishes and the sealing becomes progressively less and less efficient.

SUMMARY OF THE INVENTION

The drawbacks and problems hereinabove outlined are overcome by means of the abutment according to the present invention. One of the fundamental features of the abutment of the invention is that it does not require any sealing member of the type hereinbefore described and therefore does not require resilient members in order to urge the sealing members out of their recesses to maintain a suitable sealing behaviour. It has already been hereinabove stated that, in poligonally-shaped abutments, it is necessary to use a large quantity of such sealing members, at least one for each edge that has to establish a sealing contact, in order to avoid leakage of fluid. The abutment according to the present invention has a very small number of parts, more particularly the basic embodiment has only two parts, which are suitably interconnected such as by a tongue and groove connection and which defines at least a sloped plane which enables self-compensation of the wear produced by their use, and whereby the constitutive elements or plate members of the abutment are moved towards the walls of the housing, stator casing and the piston rotor such that these plate members will maintain a suitable pressure against all of them and thereby the required sealing of the chambers.

In short, the present invention relates to a abutment which is used in a fluid operated machine, such as a rotary motor, a compressor, a vacuum pump, a brake system, or a mechanical energy accumulator, which have a stator casing defining a substantially cylindrical inner face circumscribing a cylindrical space and an outwardly projecting housing, an eccentric piston rotor in the cylindrical space which is rollable along the inner face, a self-sealing abutment slidably housed in the housing and projects into the cylindrical space so as to be in sealing contact with the piston rotor, thereby dividing the cylindrical space into two variable volume chambers, self-sealing abutment having an upper base portion always housed in the housing and a lower base portion always in abutting contact with the piston rotor, the improvement wherein the abutment comprises at least two generally coplanar flat plate members, each having one edge (or inner side surface) in sliding contact with the other and defining a sloped plane with regard to the coplanar members, sloped plane having two ends, one end ending in the lower base portion (the combined bottom surfaces of the flat plate members), thereby dividing the lower base portion into two sections, while the other end of the sloped plane being always housed within the housing, and resilient means within the housing in urging contact with the upper base portion (the combined top surfaces of the flat plate members) for urging the lower base portion towards the piston rotor.

BRIEF DESCRIPTION OF THE DRAWINGS

FIG. 1 is a perspective view showing a first embodiment of the abutment according to the present invention.

FIG. 2 is a perspective view, partially in section, showing the basic concepts of a fluid operated machine of the type which uses an abutment in accordance with the present invention.

FIG. 3*a* is a front elevation of another embodiment of the abutment, according to the present invention.

FIG. 3*b* is a section along line b—b of the abutment shown in FIG. 3*a*.

FIG. 4*a* is a horizontal section through another embodiment of the abutment.

FIG. 4*b* shows a horizontal section through still another embodiment of the abutment, according to the present invention.

FIG. 4*c* shows a horizontal section through still further embodiment of the abutment, according to the present invention.

FIG. 5*a* shows a horizontal section through still another embodiment of the abutment according to the present invention.

FIG. 5*b* shows a horizontal section through a further embodiment of the abutment, according to the present invention.

FIG. 6 is a perspective view of a further embodiment of a abutment arrangement consisting of a plurality of adjacent plates, in relationship with a piston rotor, only partially shown.

FIG. 7 is a front elevation of another embodiment of the abutment according to the present invention.

DETAILED DESCRIPTION OF THE PREFERRED EMBODIMENTS OF THE INVENTION

Figure 8:
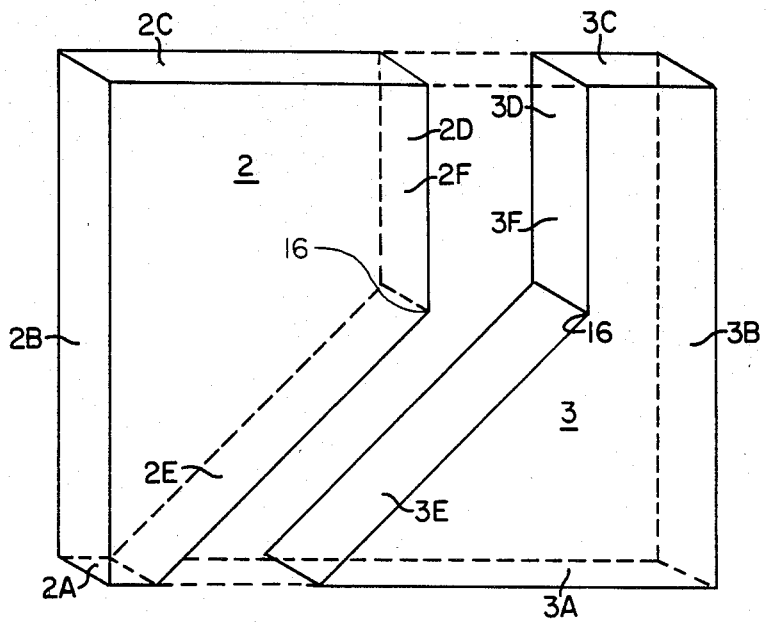
FIG. 8 is an exploded perspective view of the inventive abutment shown in FIG. 1.

To facilitate the comprehension of the present invention and prior to referring in detail to the several figures which are specifically concerned with the illustration of the abutment, it is considered advisable to make reference to FIG. 2 to provide a general understanding of the subject of a fluid operated machine, i.e., in order to facilitate the comprehension as to the behaviour and operation which has to be fulfilled by the abutment according to the present invention. In FIG. 2 a fluid operated machine is shown consisting of a generally cylindrical stator casing 14 defining a cylindrical inner face 14' circumscribing a cylindrical space 14'' and which houses a piston rotor 41 eccentrically rotatably mounted on shaft 42 and within the stator casing, where it rolls along the inner face 14'. Shaft 42 is journalled in the covered plates 13 of the stator casing 14.

The piston rotor 41 defines two variable volume chambers 39',40', by means of a dividing member or abutment 1 which is constantly in contact with the rolling face 12 of the piston rotor 41; to this end, abutment 1 is slidably housed within housing 43 which projects out of the stator casing 14 and extends in the direction of an axial line passing through the cylindrical space 14''. Abutment 1 has an upper base portion 7,7' and a lower divided base portion 10,11 which is in permanent contact with the face (periphery) 12 of the piston rotor 41 and maintains spaced apart both chambers, providing an assembly which is suitably sealed, as will be later better understood. If the machine is to operate as a motor or engine, the variable volume chambers 39',40' will respectively operate as expansion and compression chambers, while if the machine is to operate as a fluid conveying pump, the chambers will respectively be a fluid inlet and a fluid expelling chambers, as is well known in the art. Fluid inlet and outlets for the variable volume chambers are not shown to avoid overburdening of the drawing.

Having thus described the general purpose of the abutment 1 of the present invention, reference will now be specifically made thereto.

In FIG. 1 a first embodiment of the abutment according to the present invention is shown in perspective view. The abutment 1 includes two substantially coplanar plates 2, 3 in mutual contact at their edges 4, 5 whereby the assembly is a substantially rectangular shaped figure with a predetermined thickness. The abutment defines thus two opposite main faces of large surface with regard to all the other surfaces.

These main faces each face one of the variable volume chambers 39',40'. Plate 2, hereinafter called the "upper plate", slides along plate 3, hereinafter called the "lower plate". The upper plate 2 is the one which will have to compensate for the major proportion of the wear and abuts the lower plate 3 along a substantially vertical sliding plane 6 which continues into a sloped plane 5. The abutment 1 furthermore has substantially parallel side faces 9, the upper base portion 7,7' and the lower base portion 10,11. The lower base portion defines two sections of unequal length. Referring to FIG. 8, which shows the plates 2 and 3 in exploded view, the plate 2 is seen to define a bottom surface 2*a*, an outer side surface 2*b*, a top surface 2*c* and an inner side surface 2*d*, the inner side surface having a lower end which merges with the bottom surface 2*a*. More specifically, the inner side surface 2*d* is divided into a lower portion 2*e* which extends upwardly from the bottom surface 2*a* at an obtuse angle and an upper portion 2*f* which intersects the lower portion 2*e* at point 16 and then extends upwardly therefrom in parallel with the outer side surface 2*b*. The plate 3 is seen to define a bottom surface 3*a*, an outer side surface 3*b*, a top surface 3*c* and an inner side surface 3d, the inner surface 3*d* having a lower end which merges with the bottom surface 3*a*. More specifically, the inner side surface 3*d* is divided into a lower portion 3*e* which extends upwardly from the bottom surface 3*a* at an acute angle and an upper portion 3*f* which intersects the lower portion 2*e* at point 16 and then extends upwardly therefrom in parallel with the outer side surface 3*b*. The outer side surface 2*b* abd 3*b* are parallel to one another. The bottom surface 2*a* and 3*a* provide the lower base portion 10,11 of the abutment 1, the outer side surfaces 2*b* and 3*b* provide the opposite side faces 9, the top surfaces 2*c* and 3*c* provide the upper base portion 7,7', and the lower and upper portions 2*e*,3*e* and 2*f*,3*f* of the inner side surfaces 2*d* and 3*d* provide the edges 5 and 4. It can be seen that the bottom surface 2*a* of the plate 2 is shorter in length than the bottom surface 3*a* of the plate 3.

As to the operation, the abutment 1 moves up and down within its housing 43 and along the rolling face 12 of the piston rotor 41, which rotates, whereby the lower base portion 10,11 starts to wear and the smaller portion 10 in a more pronounced way. Also a certain wear will take place along the side faces 9 which slide within guide means 15 which are conveniently provided by the cover plates 13 (only schematically shown) of the stator casing 14 and housing 43. The abutment 1 which moves up and down within the housing 43 is downwardly urged by resilient means, such as springs 38 (only one shown) housed in blind bores 8, in order to press onto the piston rotor 41 and thereby maintain a constant sealing contact on the rolling face 12. Due to the spring 38, the upper plate 2 is urged towards the lower plate 3.

The resilient member or members disclosed as springs 38 may also consist of a single block of resilient means or one for each plate (not shown) and replacement thereof is extremely simple, to be carried out from the top of the housing 43.

Thus any wear may take place on the lower base portion 10,11 and the side faces 9 is compensated for by the possibility that the upper plate 2 slides along the lower plate 3.

If one assumes that the lower edge 10 will be the one which wears most, upper plate 2 will relatively slide downwardly on the sloped plane 5 and compensate thereby the wear on edge 10, thereby assuring a permanent sealing contact with the rolling face 12 of the piston rotor 41. The same result is achieved with regard to the lateral faces 9, since by moving the upper plate 2 along the sloped plane 5, there will be a lateral displacement of the upper plate 2 towards the left (with regard to FIG. 1) as well as of the lower plate 3 towards the right, whereby the lateral faces 9 will maintain their sealing contact within the guide means 15 defined by each of the cover plates 13. When such lateral movement takes place, the edges defining the sliding plane 4 will become spaced apart while on the sloped plane 5 there will be maintained the abutting relationship between the plates 2 and 3. The fact that a space will be formed between the edges defining the sliding plane 4, does not imply that any leakage will take place inasmuch as these are defining a tongue and groove connection known as a labyrinth seal, as will be explained later on. Since there are no resiliently urged sealing members on the side faces 9 and the edges defining the lower base portion 10 and 11, the useful life of the abutment is much longer than in the known arrangements of the prior art and it will not be necessary, as in the prior art, to remove the abutment from its housing or casing in order to replace worn out sealing members. The confluence of the sliding plane 4 and sloped plane 5 defines a point 16, the location of which should be such that it remains always housed within the housing 43, while the abutment is moving up and down. In other words, point 16 should never face the variable volume chambers, to achieve the best type of sealing.

In FIGS. 3*a* and 3*b* an alternative embodiment is shown where instead of providing only one assembly of plates 2 and 3, as disclosed in connection with the embodiment described in FIG. 1, two similar assemblies of facing plates are provided, but where the planes 4 and 5 are staggered so that they provide a better sealing arrangement. In fact, the first or front assembly consists of an upper plate 24 slidably located on the lower plate 26 and having a sliding plane 22 formed by edges 17 and a sloped plane 19.

In a similar organization, but symmetrically opposite, there is provided a rear assembly having a lower plate 23 and an upper plate 27 slidably located on the lower plate 23 by means of the sliding plane 21 defining the edges 18 and the sloped plane 20 as shown in FIG. 3*a* in dotted lines (because these plates 23, 27 are located behind plates 24, 26). The purpose of such an arrangement is to provide a labyrinth seal between both variable volume chambers by means of the diverging sloped planes 19, 20 and the spaced apart vertical sliding planes 17,18, separated by a common plane 25, whereby substantially no leakage between the two variable volume chambers can take place.

If desired, as will be apparent for those skilled in the art, between adjacent assemblies and within the common plane 25 a sealing material may be located. The confluence of the sliding planes 17, 18 and the sloped planes 19, 20, respectively, will define points 28, 29, respectively, which must always be located above the line I—I which is the lowermost line or base portion of the housing 43 (FIG. 1) and therefore line I—I must not exit the housing for the same reason, as explained in connection with point 16 in relationship to the first embodiment.

A somewhat similar embodiment to the embodiment of FIGS. 3*a* and 3*b* is the one shown in FIG. 7, where it may be appreciated that the sloped planes 44 and 45 of the assemblies 46, 47 end at the side faces 49, 50 of the abutment without continuing into a vertical upwardly directed sliding plane of the type of sliding planes 17 and 18 in the embodiment disclosed in FIG. 3*a*. The lower plates of both assemblies 46, 47 have corner plates 48 and 49, respectively.

This arrangement enables that the upper base portion of each assembly 46, 47 of the abutment consists of a single plate to be urged by a single elastic means (not shown and to which reference has already been made previously) which elastic means will urge the upper plates 46, 47 downwardly at the same time as moving the corner plates 48 and 49 outwardly, towards the side ends as well as downwardly towards the piston rotor, in order to achieve the self-adjusting sealing arrangement upon wear taking place. The points where the sloped planes 44 and 45 end into the side faces of the abutment, similar as in the embodiment of FIG. 2, must always remain above the line II—II which defines the lowermost edge of the housing for the abutment.

In the embodiments of FIGS. 4*a*, 4*b* and 4*c*, three different shapes of tongue and groove connection 28, 29 and 30, respectively, are shown all providing labyrinth sealings. The type of tongue and groove connection to be used depends on the type of fluid to be employed.

As such, these embodiments correspond to the type of abutment as described in connection with FIG. 1, but they could also be used in connection with the embodiments of FIGS. 3*a* and 3*b*, if two plate assemblies were provided in each case.

FIGS. 4*a*, 4*b* and 4*c* furthermore show perforations 31 in the different members which are provided either to house springs therein and/or to reduce the weight of the plate members. These perforations are also shown in the other embodiments as disclosed in connection with FIGS. 3*b* and 5*a*.

As to the embodiments of FIGS. 5*a* and 5*b*, they show two sectional views of two different embodiments, where in connection with FIG. 5*a* a tongue and groove connection 33 is shown, of a shape similar to the one disclosed in FIG. 4*c* and there identified by reference numeral 30 but in addition side faces 9 to enter in contact with the cover plates 13, are provided with antifriction members 32. These antifriction members are to improve the sealing contact between the abutment and the cover plates, but they do not require any type of elastic member which would urge them out towards the cover plates.

In the other embodiment disclosed in connection with FIG. 5*b*, a combination of different plates, some of them having antifriction features is shown to define a sandwich type of abutment. In this embodiment the upper plates may be those identified by reference numeral 37 having in between them the antifriction material plates. Similarly the lower plates would consist of plates 35 and antifriction plates 36.

Finally in FIG. 6 still a further embodiment is shown where the abutment consists of a plurality of plates 39, having each a lower face 40 in contact with the rolling face 12 of the piston rotor, so that thereby a abutment assembly is provided of a multiple type which also provides an improved sealing for separating the two variable volume chambers.

It will be understood, that improvements may be introduced in the embodiment described by way of example and modifications may be made in the construction and materials employed without departing from the scope of the invention.

I claim:

1. In a fluid-operated machine which includes a stator casing, said stator casing having a substantially cylindrical inner face that defines a substantially cylindrical space therein, said substantially cylindrical space having an imaginary axial line therethrough; an elongated housing extending outwardly from said stator casing, said elongated housing extending parallel to said imaginary axial line, said housing having opposite sides and an interior chamber which communicates with the substantially cylindrical space in said stator casing; an eccentric piston rotor positioned in the substantially cylindrical space in said stator casing, a portion of the periphery of said piston rotor being in sealing contact with the inner face of said stator casing; a piston shaft connected to said piston rotor, said piston shaft extending along said imaginary axial line, rotation of said piston shaft causing said portion of the periphery of said piston rotor to move along the inner face of said stator casing and divide said substantially cylindrical space into two variable volume chambers; a self-sealing abutment member movably positioned in the inner chamber in said elongated housing to move in and out of the substantially cylindrical space in said rotor housing based on the rotational positioning of the piston rotor therein; and a spring means located with the interior chamber in said elongated housing so as to bias said abutment member toward said piston rotor, the improvement wherein said abutment member consists of at least one plate assembly, each plate assembly consisting of two generally coplanar flat plates, each of said two generally coplanar flat plates defining a bottom surface, an outer side surface, a top surface and an inner side surface, the bottom surfaces of said flat plates being parallel and in sliding contact with the periphery of said piston rotor, the outer side surfaces of said flat plates being parallel and in sliding cooperation with the opposite sides of said elongated housing, the inner side surfaces of said two flat plates having respective lower ends which merge with the associated lower surfaces of the flat plates and upper ends which are always located within the interior chamber within said elongated housing, the lower portion of the inner side surface of the first of said two flat plates being straight and extending upwardly from its associated bottom surface at an obtuse angle, the lower portion of the inner side surface of the second of said two flat plates being straight and extending upwardly from its associated bottom surface at an acute angle, the inner side surfaces of said two flat plates being in sliding cooperation with one another such that as said first flat plate moves downwardly with respect to said second flat plate to maintain the bottom surfaces of said two plates in alignment with one another and in sealing relationship with the periphery of said piston rotor, their outer side surfaces will maintain sealing cooperation with the opposite sides of said elongated housing.

2. A fluid-operated machine as defined in claim 1, wherein said elongated housing includes a top, and wherein said spring means comprises at least one spring extending between the top of said elongated housing and the top surface of said first flat plate.

3. A fluid-operated machine as defined in claim 2, wherein said spring means also comprises at least one spring extending between the top of said elongated housing and the top surface of said second flat plate.

4. A fluid-operated machine as defined in claim 1, wherein the inner side surfaces of said two flat plates define a tongue and groove connection therebetween.

5. A fluid-operated machine as defined in claim 1, wherein an antifriction plate is located between the inner side surfaces of said two flat plates.

6. A fluid-operated machine as defined in claim 1, wherein a material having antifriction and sealing properties is located between the inner side surfaces of said two flat plates.

7. A fluid-operated machine as defined in claim 1, wherein said abutment member consists of two of said plate assemblies.

8. A fluid-operated machine as defined in claim 1, wherein said abutment member consists of five of said plate assemblies.

9. A fluid-operated machine as defined in claim 1, wherein the bottom surface of said first flat plate is shorter in length than the bottom surface of said second flat plate.

10. A fluid-operated machine as defined in claim 1, wherein the bottom surface of said first flat plate is longer in length than the bottom surface of said second flat plate.

11. A fluid-operated machine as defined in claim 1, wherein the inner side surface of said first flat plate includes an upper portion which extends in parallel with its associated outer side surface, and wherein the inner side surface of said second flat plate includes an upper portion which extends in parallel with its associated outer side surface.

12. A fluid-operated machine as defined in claim 11, wherein the lower portion and upper portion of the inner side surfaces of each of said two flat plates intersect at a point which always remains within the interior chamber within said elongated housing.

13. A fluid-operated machine as defined in claim 1, wherein antifriction members are respectively positioned between the outer side surfaces of said two flat plates and the opposite sides of said elongated housing.

14. A fluid-operated machine as defined in claim 13, wherein said antifriction members are positioned within the outer side surfaces of said respective flat plates.

* * * * *